United States Patent [19]

Rylewski

[11] 4,184,813

[45] Jan. 22, 1980

[54] FLUID ROTATING MACHINE WITH MULTIPLE DISPLACEMENT

[76] Inventor: Eugeniusz M. Rylewski, 43 bis, Avenue du Gal Leclerq, 78470 St. Remy les Chevreuse, France

[21] Appl. No.: 648,200

[22] Filed: Jan. 12, 1976

[30] Foreign Application Priority Data

Jan. 17, 1975 [FR] France ..... 75 01551

[51] Int. Cl.[2] ..... F04B 49/00; F01C 21/12; F01C 1/08; F04C 29/08

[52] U.S. Cl. ..... 417/440; 418/195

[58] Field of Search ..... 418/195, 196, 226; 417/440

[56] References Cited

U.S. PATENT DOCUMENTS

| | | | |
|---|---|---|---|
| 1,037,655 | 9/1912 | Peigler | 418/226 X |
| 1,304,497 | 5/1919 | Maxam | 418/226 |
| 1,367,801 | 2/1921 | Clark | 418/226 X |
| 1,460,875 | 7/1923 | White | 417/440 X |
| 2,956,506 | 10/1960 | Brundage | 417/440 |
| 3,904,331 | 9/1975 | Rylewski | 418/215 X |
| 4,028,016 | 6/1977 | Keiser | 417/440 |

*Primary Examiner*—Leonard E. Smith

*Attorney, Agent, or Firm*—Morgan, Finnegan, Pine, Foley & Lee

[57] ABSTRACT

In a rotative machine for fluid circulating between an inlet and an outlet comprising a plate with spiral-like passages formed by rib members, the extremities of the passages emerging into a central chamber and into a perpheral chamber, respectively, and a disc rotating in relation to the plate around a common axis and carrying vane wheels on its face in front of the plate, the vane wheels having vane members which circulate in the passages of the plate, the fluid compartments being defined by the vane members in the passages and further defined by the cooperation of the conjugated surfaces of the ridges of the ribs bordering the passages and of the disc, the improvement which comprises: means to put an outlet of the passage in communication with the discharge fluid or, alternatively, in communication with the inlet of the fluid.

2 Claims, 11 Drawing Figures

Fig. 5
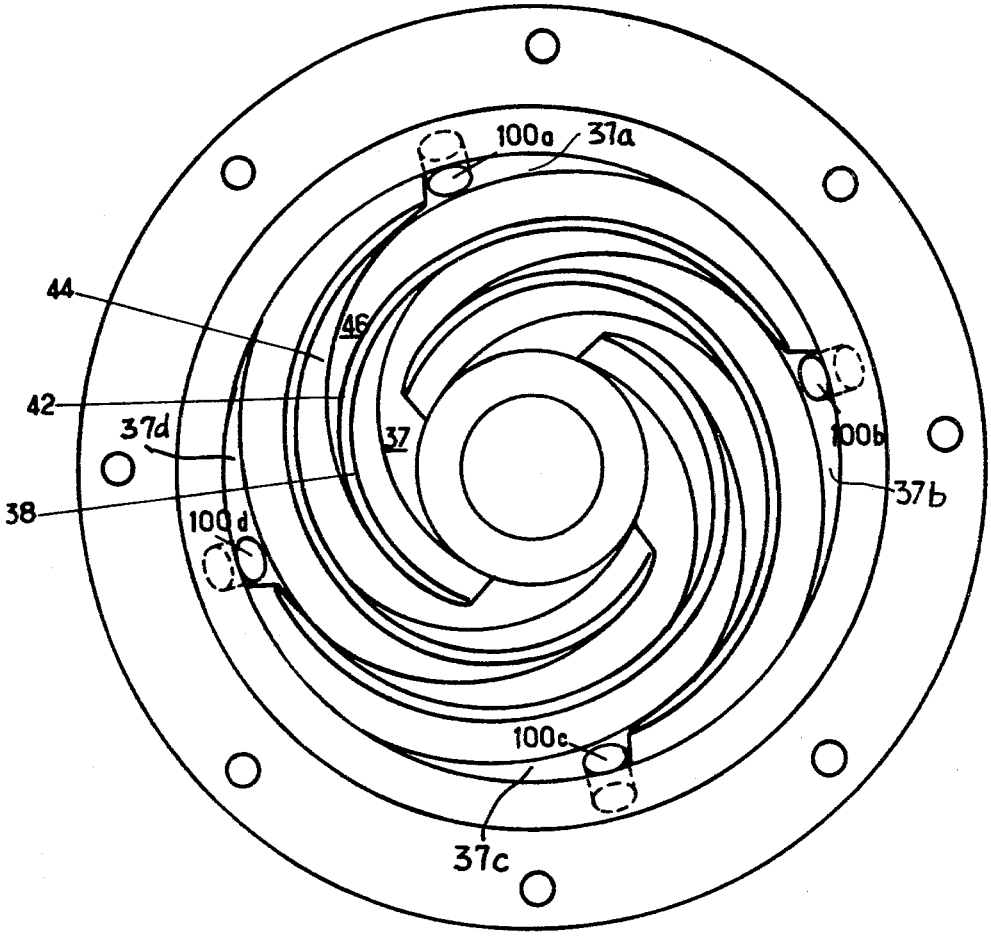
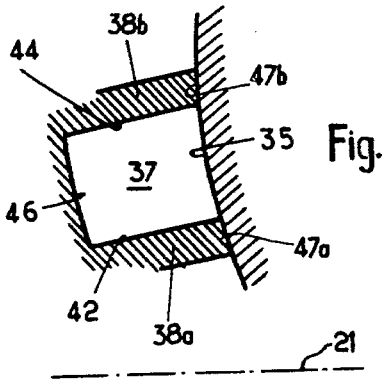
Fig.6

8
8
104
105
106
107
108
109
110
111
112
113
114
115

101
102
103

FLUID ROTATING MACHINE WITH MULTIPLE DISPLACEMENT

The object of this invention is to provide a fluid rotating machine with multiple displacement.

Fluid rotating machines previously have been proposed, comprising a plate, or stator, with spiral-like passages in which circulate the vanes of vane wheels carried by a disc, or rotor, facing the said plate, regularly distributed around an axis common to the stator and the rotor, and mounted for rotation around axes which are transverse to the said common axis, a vane of a wheel forming an end wall, in a passage of the stator of a moving compartment for fluid, the latter being additionally bordered by the conjugated surfaces of the stator and of the rotor which slide against each other.

Machines of the foregoing type are the object of the French patents listed below, all filed in the name of the present applicant:

No. 71.20194 of June 3, 1971 for "Driving or driven machine for liquids";

No. 71.20195 of June 3, 1971 for "Driving or driven machine for gases";

No. 71.20196 of June 3, 1971 for "Gas turbine".

In the aforedescribed machines, the spiral-like passages are in communication by their central extremity with a central chamber and, by their peripheral extremity, with a peripheral chamber and, in the case, for example, where the machine operates as a pump and the vanes circulate in the passages from the central extremity to the peripheral extremity, the fluid is aspirated from the central chamber and discharged, under pressure, into an annular peripheral chamber.

The object of the present invention is to provide, in such a machine, a chamber which is divided into partial chambers, each partial chamber having a passage emerging into it, and wherein means are provided to permit one or more of such partial chambers to be put into communication, at will, with the discharge of the pump or with the inlet of the pump.

When all the partial chambers are in communication with the discharge, the machine has its maximum displacement.

When, on the other hand, one of the partial chambers is put into communication with the inlet, the circulation of the vanes in the passage corresponding to the said annular chamber simply returns the fluid to the inlet chamber without any rise in pressure. The said passage is, thus, made inoperative and the displacement of the machine diminishes by the same amount.

In the following description, made as an example, reference is made to the accompanying drawings, in which:

FIG. 1 is a schematic view of the machine according to the present invention partly in elevation and partly in axial section;

While the description herein refers to the machine as a pump, it will be understood to those of ordinary skill in the art that the principle of the invention applies equally as well to hydraulic motors since the structure by its very construction is reversible.

FIG. 5 is a front view of the plate operating as a stator;

FIG. 6 is a view in section, at larger scale, of a part of the stator and of the cooperating part of the rotor;

Figure 1:
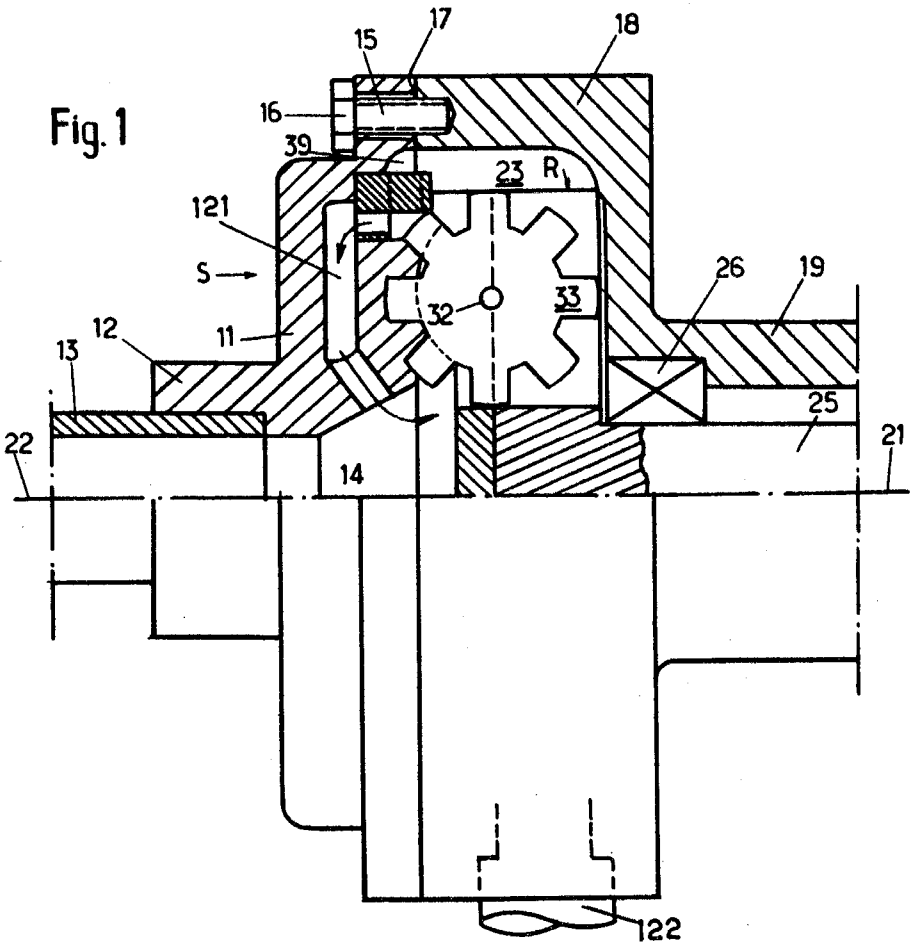

The machine comprises a stator S constituted by a plate 11 (FIG. 1) belonging to an annular core 12 in which is secured a pipe 13 connected to a reserve of liquid. The core 12 has an annular chamber 14.

Figure 2:
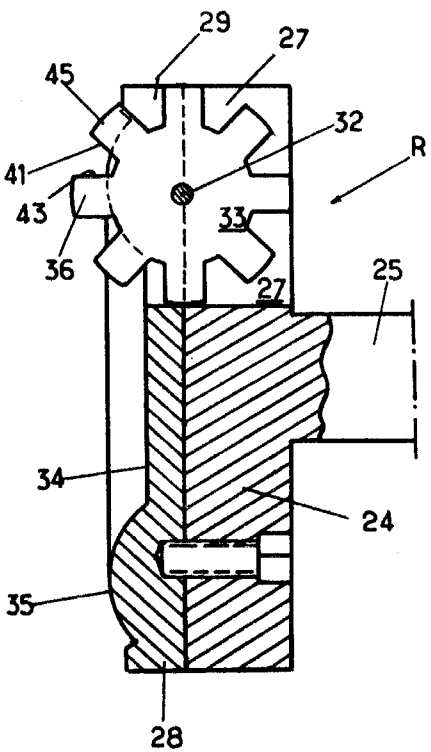
FIG. 2 is a view of a rotor of the said machine, partly in section.
Figure 4:
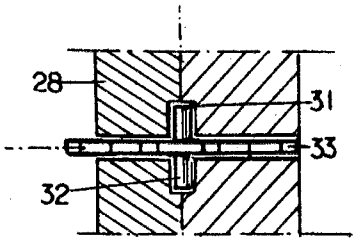
FIG. 4 is a view in section of a part of the rotor.
Figure 3:
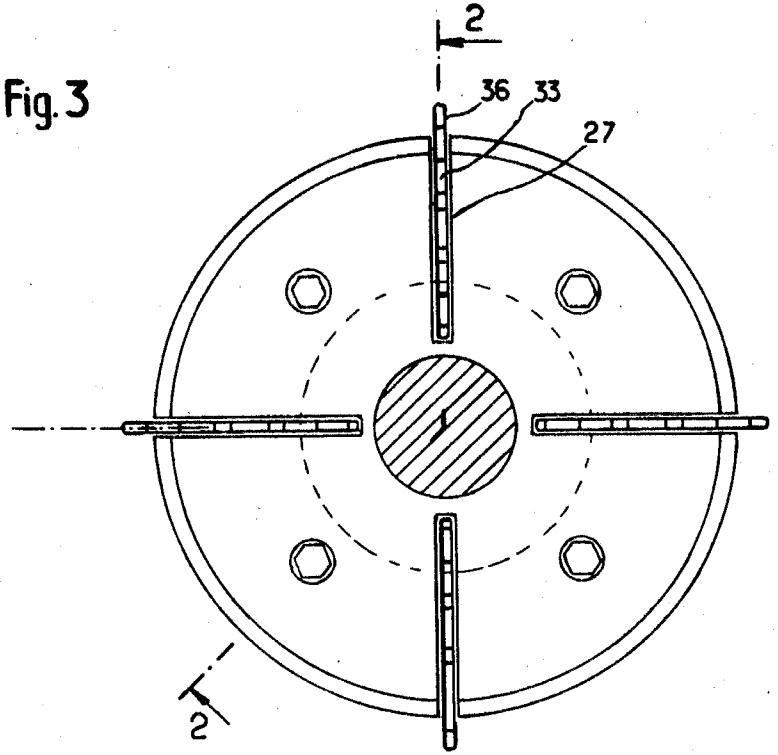
FIG. 3 is a front view of the said rotor.

The plate 11 is secured on its periphery, by the bolts 15 with heads 16, to the annular face 17 of the case 18 belonging to the casing 19, the axis 21 of the latter being the same as the axis 22 of the plate 11. In the same space 23 arranged between the case 18 and the plate 11 is housed a rotor R. The latter comprises a body 24 (FIG. 2) belonging to the shaft 25 mounted for rotation through the bearing 26 in the casing 19. The body of the rotor has diametral slots 27 (FIG. 3) regularly angularly distributed, four in number in the represented example, and therefore, 90° one from the other. The body 24 is covered by a disc 28 which has diametral slots 29 in registration, respectively, with the diametral slots 27 of the body 24. The body 24 and the disc 28 are provided with cavities 31 (FIG. 4) to house the axes 32 of the vane wheels 33; the axes 32 being perpendicular to the axis 21.

The disc 28 has, on its face in front of the plate 11, a central surface 34 which is recessed in relation to an annular surface of revolution 35. The vanes 36 of the wheels 33 protrude from the annular surface 35, and cooperate with the passages 37 (FIG. 5) made on the surface of the plate 11 facing the rotor. Those passages, four in number, in the presented example, are in the form of spirals. They are bordered by the ribs 38 in the form of spirals, each rib constituting an external side wall of a passage on its one face and also, by its opposite face, constituting the internal side wall of another passage.

When a vane 36 circulates in a passage 37, one of its edges 41 (FIG. 2) cooperates slidingly with the internal conjugated face 42 of the passage 37, the opposite edge 43 cooperates with the external surface 44 of the said passage, and the frontal edge 45 cooperates with the bottom 46 of the passage. A fluid compartment is completed by the cooperation of the surface 35 with the ridges or portions **47*a* and 47*b* (FIG. 6) of the ribs 38*a* and 38*b* bordering the passage 37**.

Figure 7:
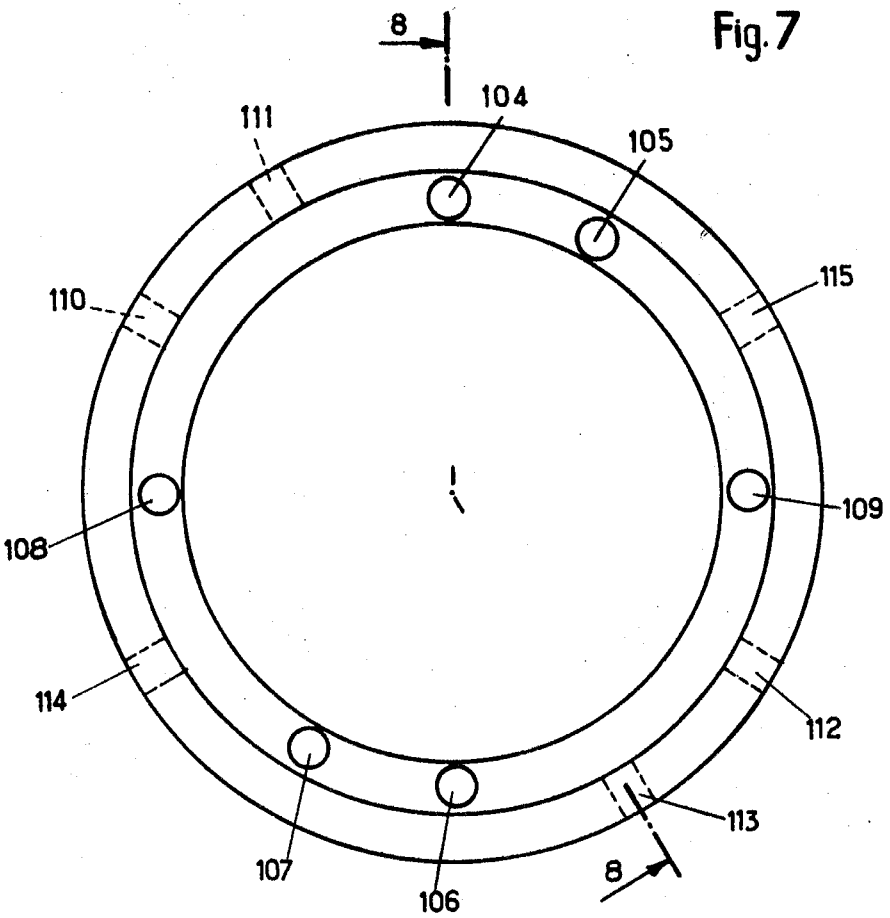
FIG. 7 is a view of the device of the present invention which provides for the modification of the displacement of the machine as shown in FIG. 1.
Figure 8:
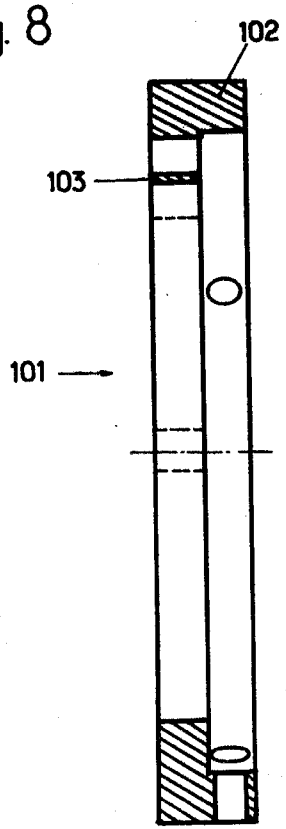
FIG. 8 is a view in section along line 8—8 of FIG. 7.

According to the present invention, a ring 101 (FIGS. 7 and 8) is mounted in the stator S, in such a way as to rotate in relation to the stator. The said ring faces the outlets of the borings **100*a*–100*d* made in the stator at right angles with the outlets of the passages, respectively, 37*a*–37*d***.

Ring 101 has a diametral section composed of two arms 102 and 103, the arm 102 has its mean line parallel to the axis common to the stator and to the rotor, whereas the arm 103 has its mean line directed diametrally.

In the arm 103 are provided two couples of through openings, 104, 105 and 106, 107, respectively, diametrically opposite one to the other. The arm 103 has two other through openings 108 and 109 located in a diametral plane perpendicular to the diametral plane passing through the axes of the openings 104 and 106.

In the arm 102 are provided, also, two couples, diametrically opposite one to the other, of through openings 110, 111 and 112, 113 and two other through openings 114 and 115 aligned along a diametral plane perpendicular to the diametral plane passing through the axes of the openings 111 and 113.

The through openings of the arm 103 are in communication with the inlet chamber 14 through the conduits 121 inside the body of the stator S.

The through openings of the arm 102 are in communication with the discharge chamber 39 arranged between the case 18 and the rotor R and from which depart the discharge piping 122.

Figure 9:
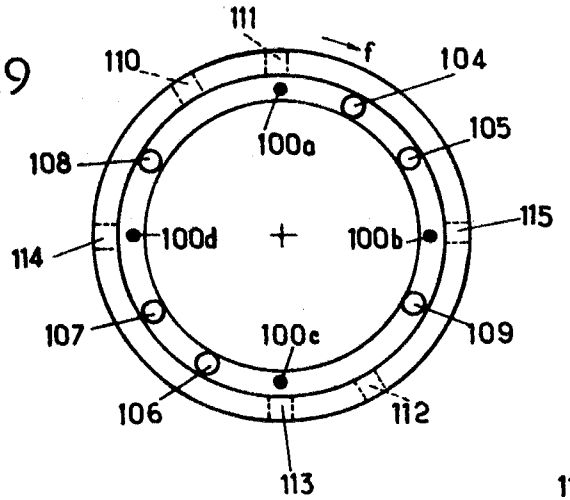
FIG. 9 is a schematic front view representing one of the operating conditions of the machine.

In the condition schematized in FIG. 9, the borings 100*a*–100*d*, made at right angles with the outlets of the passages 37*a*–37*d* respectively, of the stator, are facing, respectively, the through openings 111, 114, 113 and 115. Since openings 111, 114, 113 and 115 are each formed in the arm 102, the four spiral-like passages are, therefore, in communication with the discharge and the machine operates with its maximum "displacement".

Figure 10:
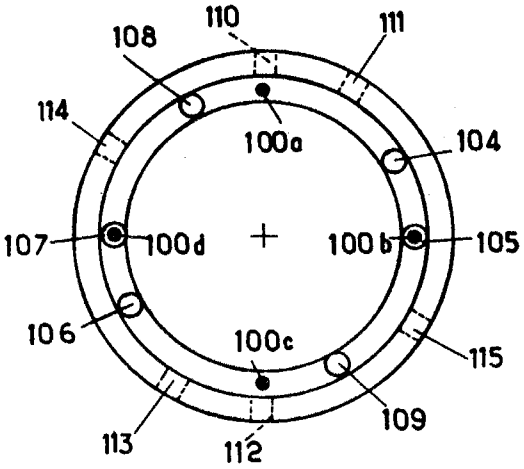
FIG. 10 is similar to FIG. 9, illustrating another operating condition of the machine.

In the condition represented on FIG. 10, and which is obtained from the preceding condition by a rotation of the ring 101, clockwise, as shown by the arrow f on FIG. 9, the opening 110 faces the boring 100*a*, the latter being therefore in communication with the discharge chamber 39. On the other hand, the opening 105 faces the boring 100*b*, and the latter is, therefore, in communication with the inlet chamber 14. The boring 100*a* is, as well as the boring 100*c*, in communication with the discharge, while, the boring 100*d*, as well as the boring 100*b*, are in communication with the inlet of the machine.

Figure 11:
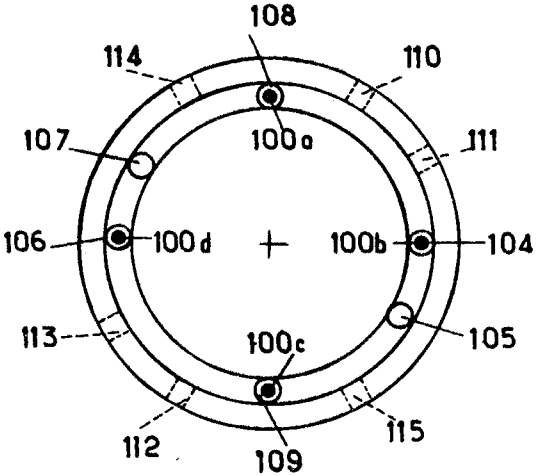
FIG. 11 is similar to FIG. 9, illustrating still another operating condition of the machine.

The borings 100 of the stator are symbolized on FIGS. 9–11 by grey spots.

In FIG. 10, the working displacement of the machine is reduced by half in comparison to the displacement in the preceding condition, illustrated in FIG. 9.

FIG. 11 shows a condition of the machine obtained from the preceding condition by an additional rotation, still in the same direction, of the ring 101 in relation to the stator. In this condition, the four borings 100*a*–100*d* at the outlets of the passages, are facing the openings 104, 109, 106, 108 respectively, the latter being in communication with the inlet of the machine through the conduits 121. The operational displacement of the machine therefore can be considered as zero, since the fluid put into circulation by the vanes in the passages is carried back to the inlet.

What is claimed is:

1. In a positive-displacement rotative machine in which the conversion of pressure energy of fluids is obtained by the circulation of at least two spaced vane members in at least one spiral-like passage of revolution defined by rib members having top surfaces and side walls, wherein said vane members are parts of at least two vane wheels, each of said vane wheels is mounted for rotation about its own axis and housed in a slot formed in a first part of said machine, said vane members circulate in said at least one spiral-like passage of revolution formed in a plate member comprising a second part of said machine, at least one of said first and second parts of said machine is rotatable, the axis of rotation thereof constituting the main axis of rotation of said machine, the axes of rotation of each of said vane wheels are transverse to said main axis of rotation of said machine, said at least one spiral-like passage of revolution is generated by a combined rotation of said vane members about the axis of rotation of their respective vane wheels and by rotation of said first part of said machine in relation to said second part of said machine, said at least one spiral-like passage is bound along its intermediate portion by a pair of said rib members while each end extremity portion thereof is bound by a single rib member, said intermediate portion of said at least one spiral-like passage is closed against the top surfaces of said rib members by a cooperating surface formed on said first part of said machine receiving said vane wheels in sliding contact therewith to thereby form channels for the circulating fluid, and said at least one spiral-like passage extends between a central inlet chamber and a peripheral outlet chamber formed in said plate member for the circulating fluid and has a continuous progressively varying cross-sectional area from the inlet to the outlet thereof, the improvement therein which comprises:

means for selectively communicating the peripheral outlet chamber of said at least one spiral-like passage with either the discharge flow or the inlet flow of the fluid circulating through said machine so as to vary the displacement of said machine, said means operating to diminish the displacement of said machine when said peripheral outlet chamber is in communication with said inlet flow by returning fluid to said inlet chamber without an increase in the pressure of the fluid flow, said means comprising a ring member having two sets of openings, said ring member being mounted for rotation relative to said plate member comprising said second part of said machine and facing the peripheral outlet of said at least one spiral-like passage, one of said two sets of openings of said ring member adapted to communicate with the discharge flow of the fluid circulating through said machine and the other of said two sets of openings of said ring member adapted to communicate with the inlet flow of the fluid circulating through said machine.

2. A machine as claimed in claim 1, wherein two or more spiral-like passages are provided, each of said passages extends between a central inlet chamber and a peripheral outlet chamber and said ring member selectively communicates each of said peripheral outlet chambers with either the discharge flow or the inlet flow of the fluid circulating through said machine.

* * * * *